US006536865B2

(12) United States Patent
Sarmast

(10) Patent No.: US 6,536,865 B2
(45) Date of Patent: Mar. 25, 2003

(54) METHOD AND APPARATUS FOR DETECTING PRINTER SERVICE STATION CAPACITY

(75) Inventor: Sam Sarmast, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/915,072

(22) Filed: Jul. 25, 2001

(65) Prior Publication Data

US 2003/0020769 A1 Jan. 30, 2003

(51) Int. Cl.[7] ..... B41J 2/165
(52) U.S. Cl. ..... 347/23; 347/35; 347/36
(58) Field of Search ..... 347/7, 19, 23, 347/35, 36, 92

(56) References Cited

U.S. PATENT DOCUMENTS 3,761,953 A * 9/1973 Helgeson et al. ..... 347/7
4,551,731 A * 11/1985 Lewis et al. ..... 347/79
5,172,140 A * 12/1992 Hirabayashi et al. ..... 347/23
5,266,975 A * 11/1993 Mochizuki et al. ..... 347/23
5,663,750 A * 9/1997 Sakuma ..... 347/7
5,764,253 A * 6/1998 Uchikata et al. ..... 347/23
6,086,190 A 7/2000 Schantz et al. ..... 347/81
6,227,642 B1 * 5/2001 Hanabusa et al. ..... 347/19
6,315,383 B1 * 11/2001 Sarmast et al. ..... 347/19

FOREIGN PATENT DOCUMENTS

JP 58-96561 A * 6/1983
JP 1-174460 A * 7/1989

* cited by examiner

*Primary Examiner*—Judy Nguyen
*Assistant Examiner*—Blaise Mouttet

(57) ABSTRACT

During ink-jet printhead servicing, nozzles fire ink droplets into a reservoir of a service station. An electrostatic drop detection circuit uses the difference between the voltage potential of the ink droplets and the voltage potential of the reservoir to create an output signal. The shape and amplitude of the signal are evaluated to determine the functionality of the printhead nozzles. The signal delay, associated with the flight time of the ink droplets, and the amplitude of the output signal are evaluated to determine the volume remaining within the reservoir of the service station. Using the remaining volume as a parameter, the rate at which printhead servicing may be calculated to optimize print quality and resources.

27 Claims, 5 Drawing Sheets

METHOD AND APPARATUS FOR DETECTING PRINTER SERVICE STATION CAPACITY

TECHNICAL FIELD

The following disclosure relates to determining the capacity remaining in the reservoir of an ink-jet printer's service station.

BACKGROUND

Ink-jet printheads typically require frequent servicing to maintain print quality. A major element of the servicing program includes ink discharge ("spitting") at frequent intervals. Spitting discharges low quality ink that may have partially dried or degraded due to the passage of time or exposure to the atmosphere. To maintain printhead health, spitting may be performed in a service station prior to printing, at intervals during printing, and before printhead capping at the conclusion of printing.

The volume of the reservoir into which the printheads spit can be a difficult design parameter. To avoid replacement of the service station during the life of the printer in which it is installed, the volume of the service station's reservoir is typically somewhat oversized, in that it can accommodate more printhead servicing than is likely to result during the printer's lifetime. However, the degree to which the reservoir is oversized may adversely affect other design parameters, such as cost, weight, size and shape. The liabilities associated with smaller service station reservoirs are equally great. In particular, the life span of some printers may be cut short and the cost of spare parts and repair may increase. An even greater liability associated with smaller service station reservoirs is that the firmware controlling the servicing of the printhead may have to be rewritten to result in less printhead servicing. This may result in added cost and degraded print quality.

One reason that the size of a service station's reservoir is such a difficult design parameter is that the duty cycle, or rate of usage, of printers can vary widely. Where a printer has a lower duty cycle, it may be very desirable to service the printhead more often, although the printer is used less. The lower duty cycle may not result in sufficient ink movement to prevent drying and clogging, and the higher rate of servicing is required to prevent print degradation. Conversely, where a printer is used in a high duty cycle environment, less printhead servicing is required per page, but more pages are printed.

As a result, the firmware controlling key printer maintenance functions may base the amount of printhead servicing in part on the duty cycle of the printer. Unfortunately, the degree to which the service station reservoir is filled is an unknown variable. Accordingly, servicing of the nozzles within a printhead is performed at a non-optimum rate in most printers.

SUMMARY

A system, method and apparatus for using an electrostatic drop detector (EDD) circuit within a printer to determine the remaining capacity of a service reservoir is described. Using information indicating the volume remaining for use within the reservoir, the rate at which printhead servicing is performed may be recalculated to result in more efficient use of resources.

An EDD circuit uses a high voltage electrical field to cause ink droplets to assume a charge by induction that is opposed to the charge within the reservoir. The electrical charge carried by the droplets per unit time results in current flow. Amplification of the current provides information on the number of ink droplets that resulted from the firing, which can then be compared against ideal results from firing a given pattern of nozzles. By firing nozzles, individually or in groups, in a series of bursts, all nozzles associated with one or more ink-jets may be tested.

According to one aspect of the method and apparatus to detect printer service station capacity, an EDD circuit and an associated method of operation provides information on both the condition of each printhead nozzle and also the remaining capacity of the reservoir portion of the service station. Due to the electrical conductivity of both wet and dry ink, an electric field extends from the surface of the ink within the reservoir. Upon arrival of the printhead within the service station area, the printhead is fired into the reservoir according to a firing pattern that tests each nozzle. The electrical charge carried by the ink droplets delivered in unit time results in the passage of an electrical current. Amplification of the current results in an output signal.

Information on the volume remaining within the reservoir and on the functionality of the nozzles of the ink-jet printhead may be obtained from examining the output signal. The output signal will have greater amplitude where all of the tested print nozzles are operational, and are delivering the expected number of charged ink droplets. Additionally, the signal will be stronger where the ink surface within the reservoir is closer to the firing nozzle; i.e. when the volume remaining within the reservoir is smaller. Additional information concerning the distance between the nozzle and the surface of the ink within the reservoir may be obtained by examination of the time delay between the firing burst sent to the printhead, thereby causing the nozzle firing, and the formation of the EDD output signal. A shorter time of delay between the firing burst and the formation of the output signal indicates a shorter flight path of the ink droplets, and a correspondingly smaller volume remaining within the reservoir.

Consequently, by examination of the shape, amplitude and delay time of the EDD output signal, the condition of the ink-jet nozzles and the volume remaining within the service station reservoir may be determined. By using information on the volume remaining, it can be determined if the rate of printhead servicing should be restricted due to a shortage of space remaining within the service station reservoir. Accordingly, more efficient balancing of the need to service the printhead with opposing design considerations is possible.

BRIEF DESCRIPTION OF THE DRAWINGS

The same numbers are used throughout the drawings to reference like features and components.

DETAILED DESCRIPTION

During ink-jet printhead servicing, nozzles fire ink droplets into a reservoir of a service station. A high voltage field causes the ink droplets to assume a charge opposed to the charge applied to the reservoir. Within the field, ink droplets are charged by induction. The electrical charge carried by the ink droplets delivered per unit time results in current flow. Amplification of the current provides an output signal having information on the number and distribution of ink droplets that resulted from the firing. This signal can be compared against ideal results from firing a given pattern of nozzles to obtain a diagnostic. The output signal additionally provides information from which the volume remaining within the reservoir may be obtained. The output signal will have greater amplitude where all of the tested print nozzles are operational and where the ink surface within the reservoir is closer to the firing nozzle and the volume remaining within the reservoir is smaller. Additional information concerning the distance between the nozzle and the surface of the ink within the reservoir may be obtained by examination of the time delay between the firing burst sent to the printhead, thereby causing the nozzle firing, and the formation of the output signal.

Accordingly, by examination of the shape, amplitude and delay time of the output signal, the condition of the ink-jet nozzles and the volume remaining within the service station reservoir may be determined. Using volume-related information, the service rate may be adjusted, to better balance the space available within the reservoir and the need to frequently service the printhead.

Figure 1:
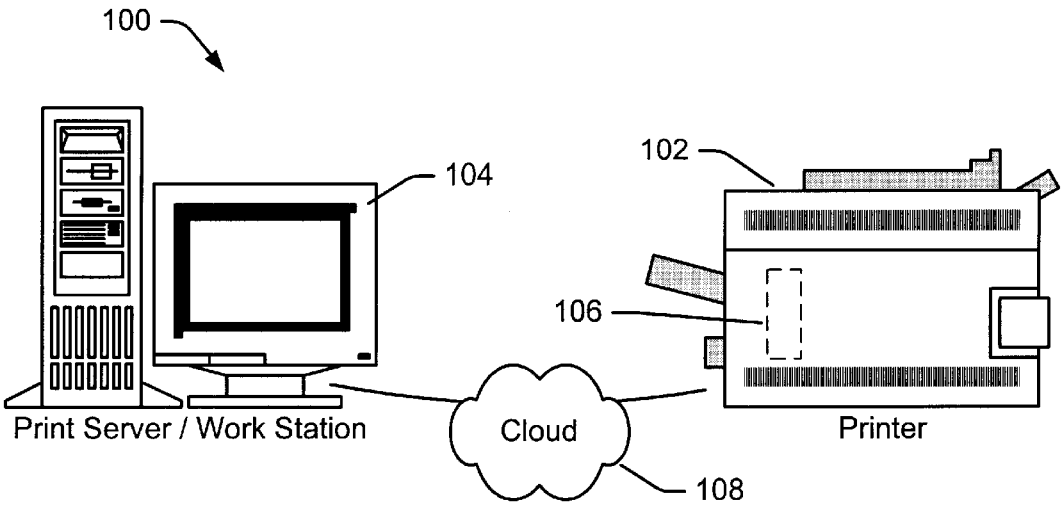
FIG. 1 is an illustration of an exemplary printing environment.

FIG. 1 shows a print system 100 having a printer 102 or similar output device such as a facsimile machine connected to a print server 104, workstation or similar computing device. The printer may have black and white or color print capability based on ink-jet technology. The printer is adapted for use with ink cartridges or alternate technology having one or more colors, such as black, cyan, magenta, and yellow. A service station 106, located within the printer's enclosure, allows the ink-jet cartridges to be serviced at intervals, including prior to use, during use, and after use. The service station includes a reservoir for printhead discharge during servicing, and includes the ability to provide feedback as to the available volume within the reservoir, as will be seen in greater detail below. The connection between the printer and print server may be made by network 108, cable or over the Internet, as required to support any desired application.

Although the print system and method for detecting printer service station capacity is described in a context wherein most of the computational steps are performed on a printer, many of the tasks could alternatively be performed on the print server or other computing device in communication with the printer. Where the computational steps are performed on the printer, the printer may be equipped with computer- and/or controller-readable media having computer- and/or controller-readable instructions. Alternatively, a computationally equivalent hardware-based solution may be substituted, using an application specific integrated circuit (ASIC) or similar technology. Execution of such software-, firmware- or hardware-based instructions supports the method for color document translation, as shown and described.

Figure 2:
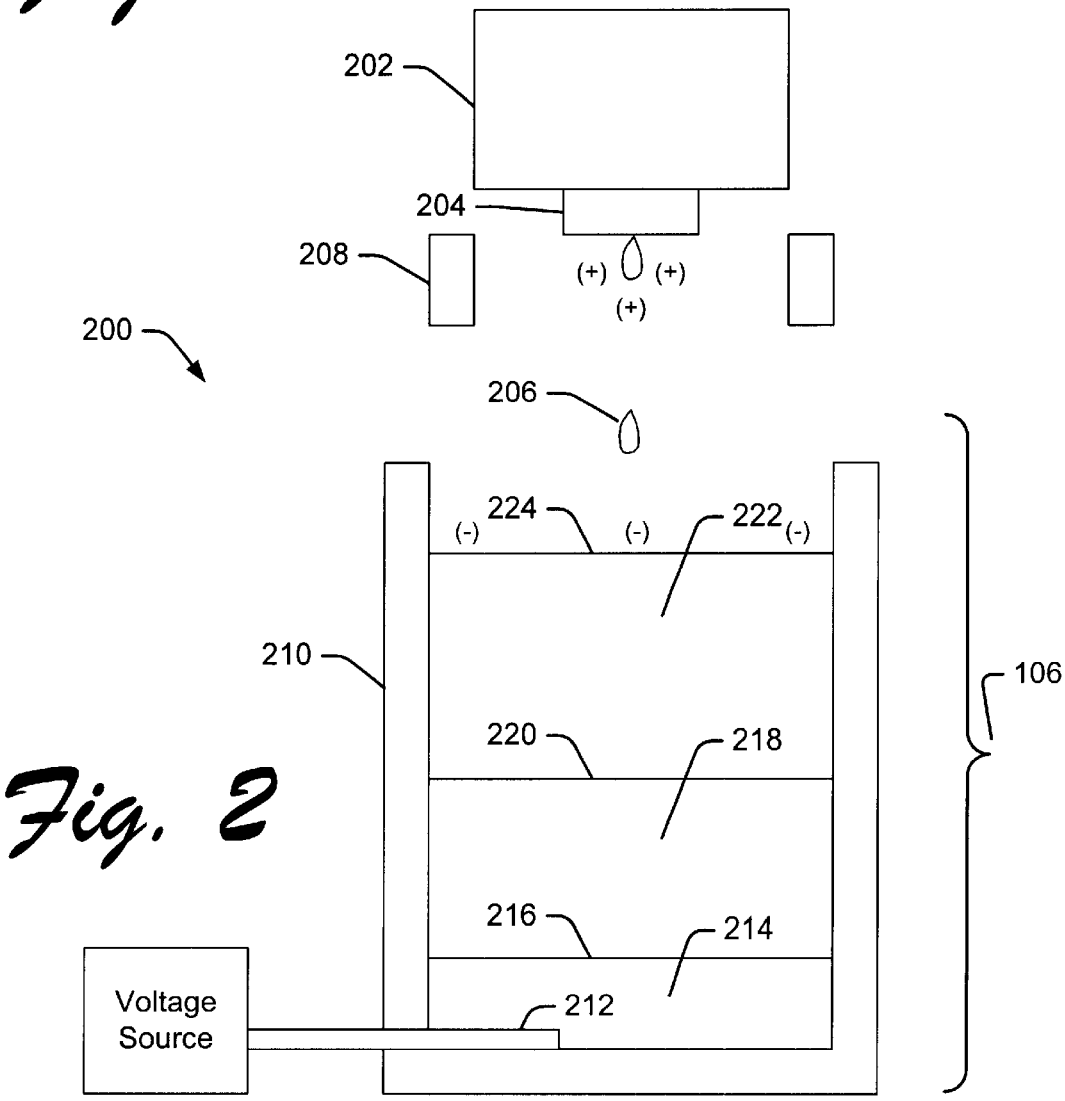
FIG. 2 is a cross-sectional diagram, illustrating an implementation of an apparatus for detecting printer service station capacity.

FIG. 2 shows an implementation of an apparatus 200 for detecting the capacity of a reservoir carried within a printer service station 106. A printhead 202 includes a nozzle 204 firing an ink droplet 206. Optionally, an electrical field generator 208 applies an electrical charge to the ink droplet 206. While either a positive or negative charge may be applied, a positive charge is shown for illustrative purposes only. The printhead is located within the service station 106 during servicing, thereby allowing it to discharge ("spit") potentially fouled ink into a service station reservoir 210. During the servicing procedure, the reservoir is held at a desired voltage potential by an electrode 212.

After an initial use, a small quantity of ink 214 having a surface 216 is present within the reservoir. Because the ink is electrically conductive, it is held at the electrical potential of the electrode 212. Over the course of many additional servicing episodes, additional ink 218 is deposited on top of ink 214. As a result, the surface 220 of the ink contained within the reservoir is closer to the nozzle 204, and less unused volume remains within the reservoir 210. Much later in the lifecycle of the printer, additional ink 222 is deposited. The surface 224 of the ink is still held at the same electrical potential as the electrode. The charge applied to the reservoir results in formation of an opposing charge on the ink droplets. In the implementation shown, the electrode applies a negative charge to the ink within the reservoir.

As will be seen, the apparatus 200 determines the location of the surface of the ink to calculate the useful volume remaining within the reservoir. In particular, where the surface 216 of the ink is more distant from the printhead nozzle, a greater volume remains, and where the surface 224 is closer to the printhead a lesser volume remains.

Figure 3:
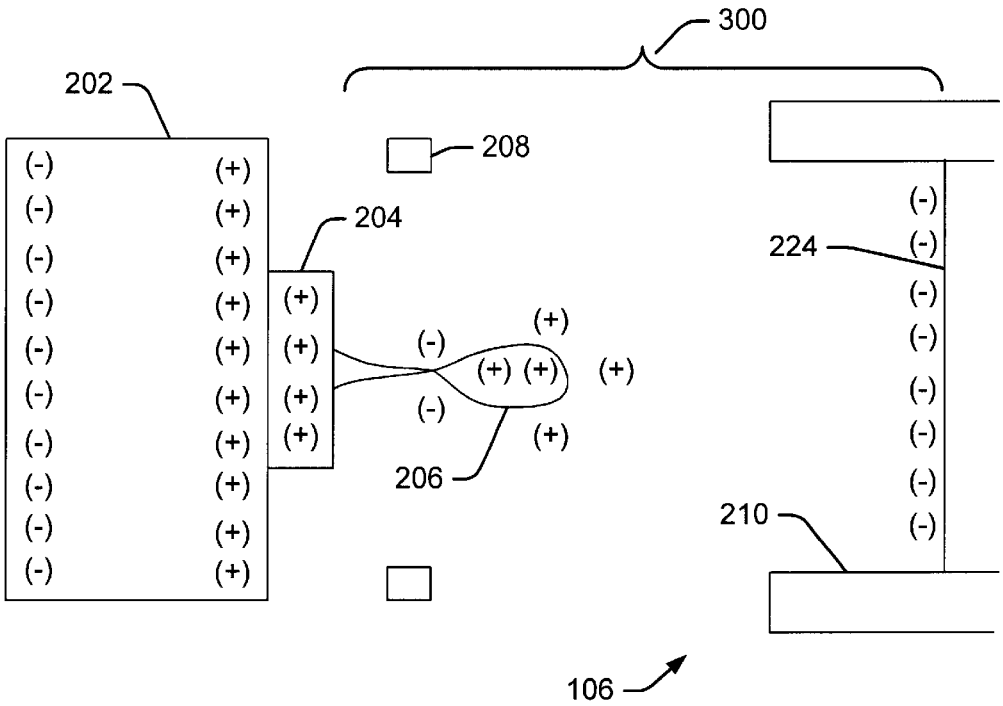
FIG. 3 is a diagram illustrating the electrical charge forming on a drop of ink being discharged from a printhead.

FIG. 3 shows a region 300 between the nozzle 204 of a printhead 202 and the surface 224 of the ink contained within the reservoir 210 of the service station 106. It can be seen that a positive electric charge has formed on the surface of the printhead. A separate field generator may induce this charge, or the charge may result from interaction with the field extending from the surface of the ink carried within reservoir.

As the ink droplet 206 extends from the nozzle 204, a condition known as breakoff results, wherein the field within the region 300 causes charge migration within the drop with positive charges being attracted in the negative field direction and vice versa. After breakoff, the ink droplet is left with a net positive charge that is proportional to the strength of the electric field within the region 300.

The electric field strength within the region 300 is also proportional to the distance between the nozzle 204 and the surface of the ink 216, 220, 224. Thus, a smaller the distance between the nozzle and ink surface will result in an electric field having greater strength, and vise versa. Where the field strength is greater during the breakoff process forming an ink droplet, the charge imparted to the ink droplet will be greater. Accordingly, the level of the charge on the ink droplet is proportional to the distance between the nozzle and the ink surface carried within the reservoir 210. Furthermore, as will be seen in greater detail below, the amplitude of the output signal resulting from the current passing via the ink droplets is proportional to the distance between the nozzle and the ink surface.

Figure 4:
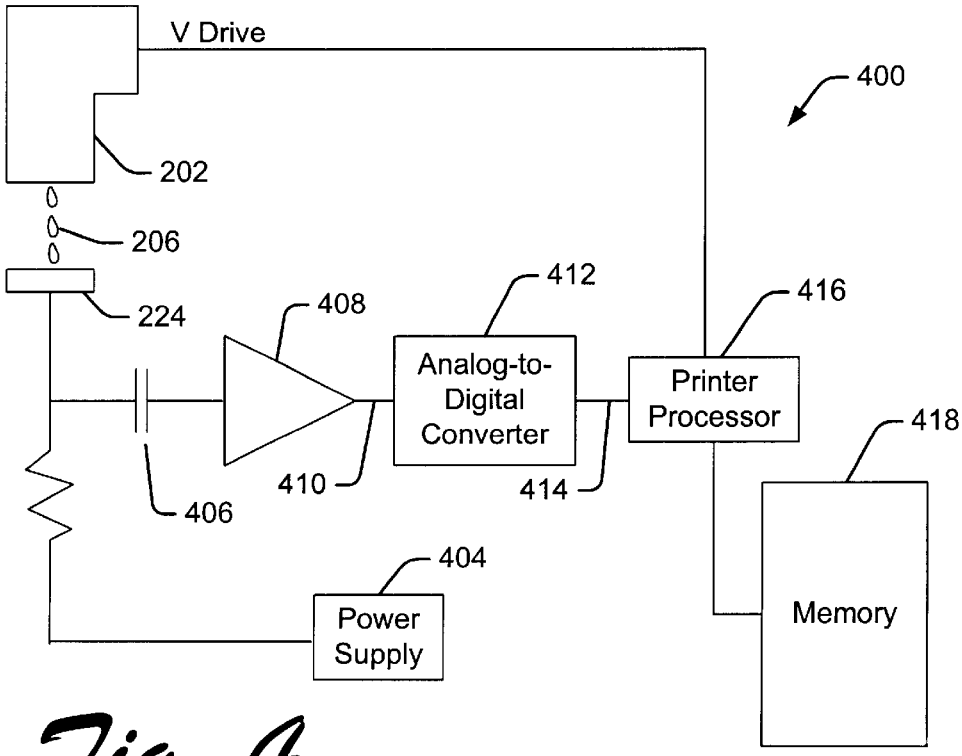
FIG. 4 is a schematic showing an embodiment of the electronics associated with the implementation of FIG. 2.

FIG. 4 shows an exemplary drop detector circuit 400. A printhead 202 fires ink droplets 206 at the surface of the ink 224 contained within the reservoir of a service station. The voltage potential of the ink is held at a desired level by a power supply 404. The result of the impact of the charged ink droplets on the ink surface within the reservoir causes a displacement current in capacitor 406 that is sensed by the current to voltage amplifier 408. The resulting electrostatic drop detector (EDD) signal 410 is converted into a digital EDD signal 414 by an analog to digital converter 412. The digital signal is fed into a print processor 416. One or more memory devices 418 provide the print processor with printing information with which the processor drives the printhead.

Figure 5:
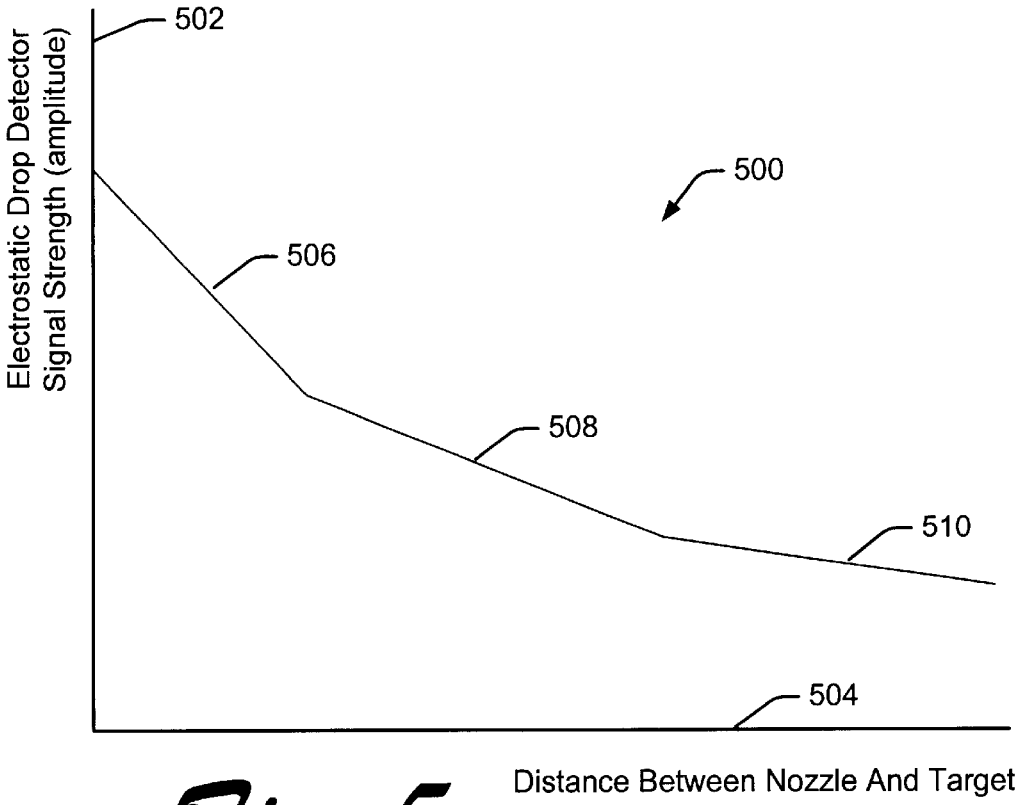
FIG. 5 is a graph illustrating the relationship between EDD signal strength and the distance between the printhead and the printer service station reservoir.

FIG. 5 shows an exemplary graphical representation 500 of the relationship between the strength of the EDD 410 strength and the distance between the nozzle and target. In particular, FIG. 5 shows exemplary data illustrating the fall-off of the EDD signal strength as the distance between the nozzle and the ink surface is increased. The EDD signal strength is plotted along the vertical axis 502, while the spacing between the nozzle and target is plotted along the horizontal axis 504.

Referring to the graph, it can be seen that an initial rate 506 at which the EDD signal strength initially falls off is rapid. An intermediate rate 508 at which the signal strength falls off is lower than the initial rate. The rate 510 at which the signal strength falls off after additional distance is put between the nozzle and ink surface is more gradual. Accordingly, the amplitude of the EDD signal may be used to determine the distance between the nozzle and the ink surface. However, the accuracy of this method is greater when the distance to be measured is smaller, and more precise evaluation of the EDD signal is required to measure greater distances.

Figure 6:
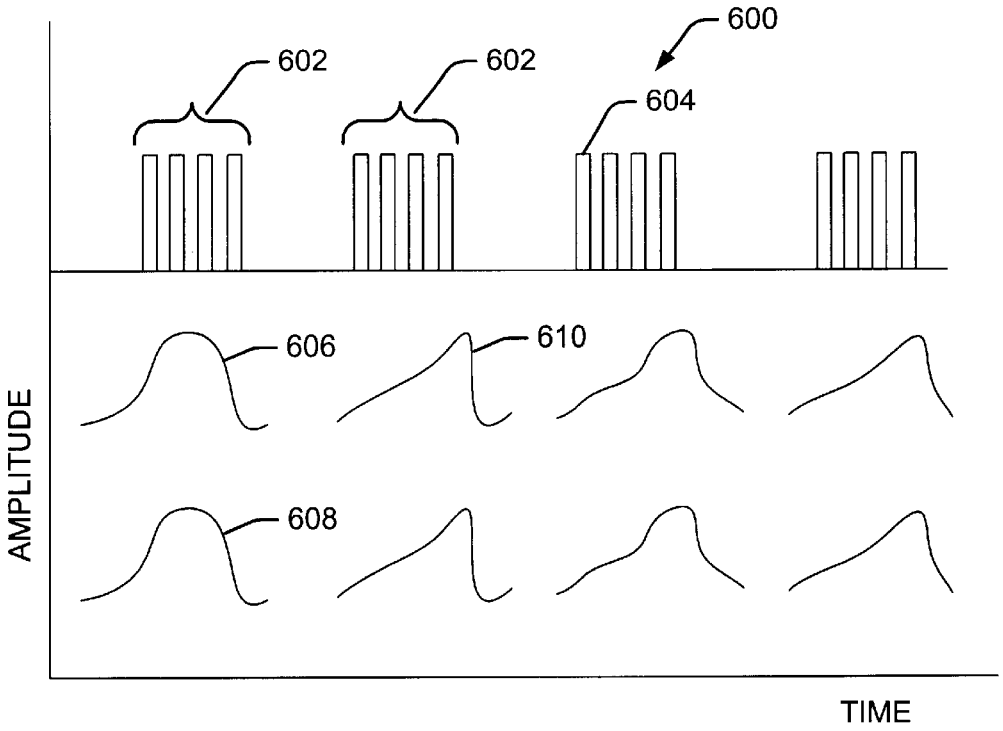
FIG. 6 is a diagram illustrating the relationship between the bursts sent to the printhead and the resulting EDD signal.

FIG. 6 shows the relationship 600 between a firing signal 602 applied to a plurality of nozzles and the resulting EDD signal. Each firing signal may be associated with a group of one or more nozzles. Accordingly, each nozzle may be tested in parallel with other nozzles in a faster manner than if each nozzle were tested sequentially. In a typical implementation, each firing signal or burst is made up of a plurality of short signals 604, four of which are shown in FIG. 6. The number of short signals is variable, but allows each nozzle to be turned on and off a number of times.

Depending on a variety of factors, a firing signal 602 can result in an EDD signal having one of a variety of different waveform shapes. Two example EDD signal waveforms are shown in FIG. 6, generally designated by reference numerals 606 and 608. The waveform at any given time is referred to as a signature signal or waveform.

In the examples shown, EDD signal 606 has greater amplitude, possibly indicating that the target surface was closer to the firing nozzles, resulting in greater electric field strength and an EDD signal with correspondingly greater amplitude. In contrast, if EDD signal 608 results from the firing,signal 602, the smaller amplitude may indicate a greater distance between the target surface and the firing nozzles. Alternatively, the difference in amplitude may be related to the functionality of the nozzles within the printhead, as will be seen.

EDD signal 606 represents a "verified" or known correct EDD signal resulting from a known firing burst applied to a properly functioning nozzle. EDD signal 610 represents a signal resulting from the same firing burst 602 applied to a malfunctioning nozzle. Differences in the shape of the signals are indicative of the malfunction of the print nozzle. Each waveform includes elements of both shape and amplitude, where the amplitude is related to the number of ink droplets and to the distance between the nozzle and target. The shape of the signal is related to the functionality of the nozzles that fired. A calibration process allows the shape and amplitude of the signature signal to be compared to a verified signal, having known correct shape and amplitude. Deviation from this verified signal indicates that one or more nozzles are failing, and require servicing or replacement.

Figure 7:
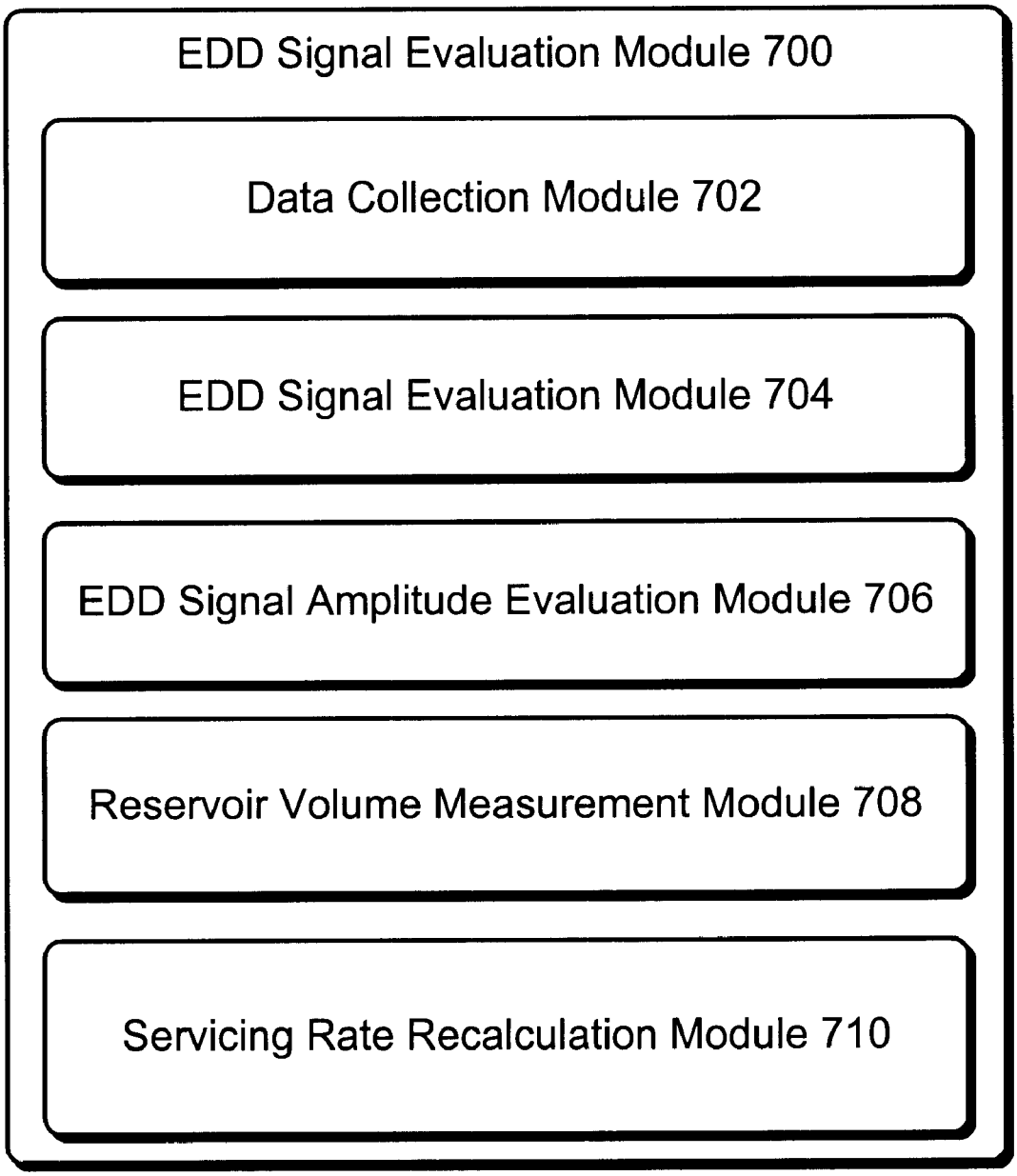
FIG. 7 is a block diagram illustrating the relationship between exemplary software and data file structures associated with the method and apparatus for detecting printer service station capacity.

FIG. 7 is a block diagram illustrating an implementation of an EDD signal evaluation module 700. The EDD signal evaluation module may be implemented as a software structure including statements executed by a processor, or may be implemented in hardware, such as by an application specific integrated circuit (ASIC). The EDD signal evaluation module evaluates the digital EDD signal 414 resulting from the current flow via electrically charged ink droplets fired by the printhead nozzle into the reservoir of the service station.

Each time the printhead visits the service station, an EDD signal evaluation module makes a number of calculations. The time delay, between firing of the nozzles and the resulting EDD signal, is evaluated to determine the duration of the airborne flight of the ink droplets, and consequently the distance between the nozzle and the surface of the ink within the reservoir. The signal strength or voltage amplitude of the EDD signal is evaluated to determine the functionality of the nozzles. The signal strength is also evaluated to determine and/or confirm the distance between the nozzle and the surface of the ink carried within the reservoir. The shape of the EDD signal is also evaluated, for comparison to a verified signal. The verified shape is derived in a calibration process with printheads known to be in working order. Given the remaining volume within the reservoir, the age of the printer and other factors, the rate at which the printheads should be serviced by discharging ink into the reservoir is recalculated.

A data collection module 702 controls the pattern of firing bursts sent to nozzles of the printhead and collects and correlates the resulting EDD signals. Due to the number of nozzles to be tested, it is typically the case that a plurality of nozzles is grouped together for each burst. The EDD signals therefore reflect the nozzle patterns used in the associated burst and the distance between the nozzles and the target. The target can be either the fixed target or the ink surface 216, 220, 224 of the reservoir.

An EDD signal evaluation module 704 evaluates the EDD signal to determine the printhead nozzle functionality. In particular, the shape and amplitude of the EDD signal is evaluated to determine if the nozzles to which firing signals were sent actually fired correctly. Correct firing implies that the number and timing of the drops fired from the nozzles correspond to the firing burst sent to the printhead. The shape and amplitude of the resulting EDD signal is therefore compared to the expected or verified EDD signal shape and amplitude given the nozzle firing pattern and the distance from the target surface. The verified shape and amplitude are obtained by using working printheads in a calibration process. Where the EDD signal is not within the parameters expected, an appropriate error handler is called or maintenance procedure is invoked.

An EDD signal amplitude evaluation module 706 analyzes the amplitude of the EDD signal to determine the distance from the target. As seen in FIG. 5, greater amplitude of the EDD signal is associated with a smaller distance between the nozzle and target, and vise versa. Accordingly, the circuit 400 of FIG. 4 may be calibrated with respect to the geometry associated with the nozzle and the service station reservoir. Where the nozzles are found to be in working order by the signal evaluation module 704, due to the output signal shape, a burst of droplets fired at the ink surface within the reservoir will result in an EDD signal of given amplitude. The amplitude may be translated into a distance by which the nozzle and ink surface are separated according to the chart in FIG. 5. Similarly, the translation may be made by a comparison to a number of known calibration values.

A reservoir volume measurement module 708 measures the flight time of ink droplets and calculates the distance between the ink-jet nozzle and the target. The flight time of the ink droplets is calculated by measuring the time elapsed between the firing of a burst of ink droplets by the printhead and the resulting EDD signal. The speed of the ink droplets is considered to be a constant related to the printhead, and in a typical implementation is about 10 meters per second. Thus, the distance between the printhead and ink surface 216, 220, 224 may be measured by multiplying the speed of the ink drops by the time of their flight.

A servicing rate recalculation module 710 receives updated information detailing the volume remaining within the service station reservoir from the EDD signal amplitude evaluation module 706 and/or the reservoir volume measurement module 708. Additional information on the condition and age of the printer is obtained from the printer or print server. Both types of information are used to determine the correct rate at which the printhead is serviced; e.g. the number of times per page or job that the printhead is serviced. Generally, where the reservoir is empty the rate of servicing is not restricted. Where the reservoir is nearly full, it may be necessary to restrict printhead servicing to prevent failure of the service station due to the reservoir filling. By recalculating the rate at which printhead nozzle servicing is performed, a better balance between the need to service and the limits of the service station reservoir may be achieved.

Figure 8:
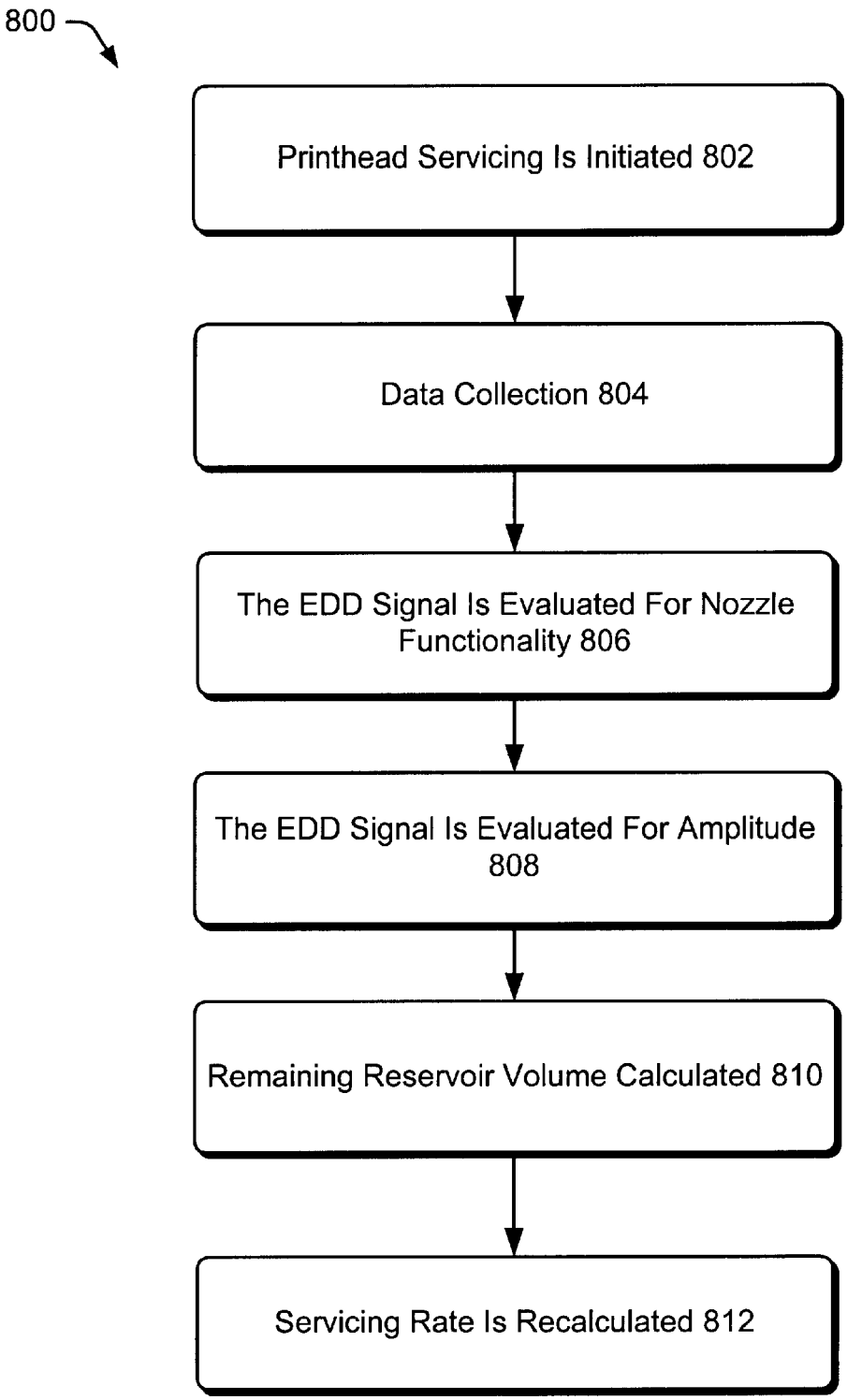
FIG. 8 is a flow diagram illustrating an exemplary operation of an apparatus for detecting printer service station capacity.

FIG. 8 shows an exemplary method 800 by which printhead functionality is measured and the remaining capacity of the printer's service station reservoir is determined, thereby allowing the rate of servicing of the printheads to be recalculated.

At block 802, printhead servicing is initiated. Printhead servicing involves the printhead moving into the service station 106 where each nozzle in the printhead discharges ink. Firing bursts result in the discharge of ink, which generates an EDD signal allowing a determination to be made with regard to the functionality of the printhead nozzles, the capacity of the reservoir and to establish the correct rate of servicing.

At block 804, the nozzles discharge a plurality of firing patterns into the reservoir. The discharge services the nozzles, by removing degraded ink and improving future print quality. In a typical implementation, a firing pattern that fires groups of nozzles allows each nozzle to be fired, while reducing the time required as compared to sequential firing. The data collection module 702 collects EDD signal data associated with each nozzle firing combination. In particular, the shape and amplitude of each EDD signal resulting from each nozzle firing is obtained for analysis.

At block 806, the EDD signal evaluation module 704 determines the functionality of each nozzle within the printhead. The shape of the measured EDD signature signal is compared to the shape of a verified EDD signal associated with fully functional nozzles. Where a discrepancy exists between the signature EDD signal and the verified EDD signal, an error message may be generated, or additional servicing performed.

At block 808, the volume remaining within the service station reservoir is calculated by examination of the EDD signal's amplitude. As seen above, the EDD signal amplitude evaluation module 706 evaluates the EDD signal to estimate of the distance between the printhead and the ink surface in addition to, or in place of, the evaluation by the distance measurement module 708. Because signal amplitude is a function of the distance between nozzle and target, the closer the printhead and target are, the greater the field strength and the greater the amplitude of the EDD signal. Thus, the amplitude of the EDD signal can be compared to EDD signals calibrated at various distances between the printhead and the target. Accordingly, an estimate of the distance between the nozzle and surface of the ink within the reservoir may be made, and an estimate of the remaining volume derived.

At block 810, the reservoir volume measurement module 708 measures the remaining volume within the reservoir. The measurement is made by using the time delay between the nozzle firing and the generation of an associated EDD signal. The EDD signal is generated by contact between the ink droplets and the target, such as the surface 224 of the ink within the reservoir. The time delay is associated with the time during which an ink droplet flies through the air. Because the speed of the ink droplets can be determined by calibration of a given printhead, the distance between the printhead and the target can be easily determined by multiplying the speed by the time. Accordingly, the volume of the service station reservoir that remains to be filed may be determined.

At block 812, the servicing rate recalculation module 710 recalculates the rate at which the printhead is serviced. As seen above, the needs of the printhead nozzles for servicing are balanced against the risk that the service station reservoir will be prematurely filled.

Conclusion

The techniques described above allow for use of an electrostatic drop detector circuit to obtain information on the remaining capacity of the service station reservoir, and to make any needed changes to the rate of printhead servicing. This results in more economical utilization of the service station reservoir, thereby decreasing the need for expensive spare parts. Moreover, by adjusting the rate at which printhead servicing is performed, print quality can be maintained at a high level through out the life cycle of the printer.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

What is claimed is:

1. A method, comprising:

measuring a remaining volume of empty space within a waste ink reservoir;

purging ink from a printhead into the waste ink reservoir; and calculating a rate at which printhead purging is performed based on the remaining volume.

2. The method of claim 1, wherein measuring comprises:

timing a period during which ink droplets travel between a printhead nozzle and the waste ink reservoir; and associating the period with the remaining volume within the waste ink reservoir.

3. The method of claim 1, wherein measuring comprises:

measuring a delay period between a firing burst sent to a printhead nozzle and an electrostatic drop detection output signal generated in response to receipt, within the waste ink reservoir, of ink drops generated by the firing burst; and multiplying the delay period by an ink drop speed.

4. The method of claim 1, wherein measuring comprises:

evaluating an amplitude of an electrostatic drop detection output signal generated in response to receipt, within the waste ink reservoir, of ink drops; and comparing the amplitude to a verified value.

5. A method of claim 1, wherein calculating comprises:

restricting a rate of printhead purging when the remaining volume is limited; and performing purging operations at an unrestricted rate when the remaining volume is not limited.

6. A method of claim 1, additionally comprising restricting a rate of printhead purging when the remaining volume is limited.

7. A method of claim 1, additionally comprising evaluating an electrostatic drop detection signal generated in response to droplets moving into the waste ink reservoir to determine a level of functionality of a nozzle.

8. A method of servicing a printhead, comprising:

timing a period between a nozzle firing and generation of an electrostatic drop detection signal to calculate a remaining volume within a service station reservoir; and recalculating a rate at which printhead servicing is performed based on the remaining volume.

9. A method of servicing a printhead, comprising:

timing a period between a nozzle firing and generation of an electrostatic drop detection signal to calculate a remaining volume within a service station reservoir;

recalculating a rate at which printhead servicing is performed based on the remaining volume; and evaluating the electrostatic drop detection signal to determine a level of functionality of a nozzle.

10. A method of claim 9, wherein recalculating comprises:

restricting a rate of printhead servicing when the remaining volume is limited; and performing printhead servicing at an unrestricted rate when the remaining volume is not limited.

11. A method of claim 9, wherein recalculating comprises restricting a rate of printhead servicing when the remaining volume is limited.

12. A system, comprising:

a reservoir volume measurement module to measure a remaining volume within a service station reservoir by using a measurement of the time between a printhead firing signal and generation of an electrostatic drop detector signal; and a service rate recalculation module to receive information on the remaining volume within the service station reservoir and to recalculate a rate of service based on the remaining volume.

13. The system of claim 12, additionally comprising:

an electrostatic drop detector signal evaluation module to evaluate the electrostatic drop detector signal and to determine the functionality of a printhead nozzle.

14. The system of claim 12, additionally comprising:

an electrostatic drop detector signal amplitude evaluation module to evaluate the distance between a printhead nozzle and the service station reservoir and to determine an available volume within the service station reservoir.

15. One or more processor-readable media having processor-readable instructions thereon which, when executed by one or more processors cause the one or more processors to:

time a period between a nozzle firing and generation of an electrostatic drop detection signal to calculate a remaining volume within a service station reservoir;

recalculate a rate at which printhead servicing is performed based on the remaining volume; and evaluate the electrostatic drop detection signal to determine a level of functionality of the nozzle.

16. One or more processor-readable media having processor-readable instructions thereon which, when executed by one or more processors cause the one or more processors to:

measure a remaining volume of empty space within a waste ink reservoir;

purge ink from a printhead into the waste ink reservoir; and recalculate a rate at which printhead purging is performed based on the remaining volume.

17. The one or more processor-readable media of claim 16, having further instructions which cause the one or more processors to:

time a period during which ink droplets travel between a printhead nozzle and the waste ink reservoir; and associate the period with the remaining volume within the waste ink reservoir.

18. The one or more processor-readable media of claim 16, having further instructions which cause the one or more processors to:

measure a delay period between a firing burst sent to a printhead nozzle discharging into the waste ink reservoir and receipt of an electrostatic drop detection output signal; and multiply the delay period by an ink drop speed.

19. The one or more processor-readable media of claim 16, having further instructions which cause an interval between purging operations to be based on the remaining volume within the waste ink reservoir.

20. The one or more processor-readable media of claim 16, having further instructions which causes an amount of ink purged by a purging operation to be based on the remaining volume within the waste ink reservoir.

21. One or more processor-readable media having processor-readable instructions thereon which, when executed by one or more processors cause the one or more processors to:

evaluate an amplitude of an electrostatic drop detection output signal;

compare the amplitude to verified values to determine a volume remaining within a service station reservoir; and recalculate a rate at which printhead servicing is performed based on the volume remaining.

22. The one or more processor-readable media of claim 21, having further instructions which cause the one or more processors to:

restrict a rate of printhead servicing when the volume remaining is limited; and perform printhead servicing at an unrestricted rate when the volume remaining is not limited.

23. A printer, comprising:

means for timing a period between a nozzle firing and generation of an electrostatic drop detection signal to calculate a remaining volume within a service station reservoir;

means for recalculating a rate at which printhead servicing is performed based on the remaining volume; and means for evaluating the electrostatic drop detection signal to determine a level of functionality of a nozzle.

24. The printer of claim 23, wherein the means for recalculating comprises:

means for restricting a rate of printhead servicing when the remaining volume is limited; and means for performing printhead servicing at an unrestricted rate when the remaining volume is not limited.

25. The printer of claim 23, wherein the means for recalculating comprises:

means for restricting a rate of printhead servicing when the remaining volume is limited.

26. A printer, comprising:

means for timing a period between a nozzle firing and generation of an electrostatic drop detection signal to calculate a remaining volume within a service station reservoir; and means for recalculating a rate at which printhead servicing is performed based on the remaining volume.

27. A processor-readable medium comprising processor-executable instructions for servicing a printhead in a printer, the processor-executable instructions comprising instructions for:

timing a period between a nozzle firing and generation of an electrostatic drop detection signal to calculate a remaining volume within a service station reservoir; and recalculating a rate at which printhead servicing is performed based on the remaining volume.

* * * * *